US008234991B2

(12) United States Patent
Caricato

(10) Patent No.: US 8,234,991 B2
(45) Date of Patent: Aug. 7, 2012

(54) SAIL PROPULSION SYSTEM

(76) Inventor: Pietro Caricato, Milan (IT)

( * ) Notice: Subject to any disclaimer, the term of this patent is extended or adjusted under 35 U.S.C. 154(b) by 0 days.

(21) Appl. No.: 12/680,648

(22) PCT Filed: Sep. 26, 2008

(86) PCT No.: PCT/EP2008/062940

§ 371 (c)(1),
(2), (4) Date: Mar. 29, 2010

(87) PCT Pub. No.: WO2009/050023

PCT Pub. Date: Apr. 23, 2009

(65) Prior Publication Data

US 2010/0218711 A1 Sep. 2, 2010

(30) Foreign Application Priority Data

Oct. 19, 2007 (IT) ..... MI2007A2037

(51) Int. Cl.
*B63H 9/06* (2006.01)

(52) U.S. Cl. ..... 114/39.29; 114/102.19; 114/102.29; 114/102.16

(58) Field of Classification Search ..... 114/39.29, 114/102.1–102.33
See application file for complete search history.

(56) References Cited

U.S. PATENT DOCUMENTS 3,223,064 A * 12/1965 White ..... 114/39.32
4,230,060 A 10/1980 McCoy
4,248,281 A * 2/1981 Hood ..... 114/106
4,506,620 A 3/1985 Gerr
4,723,498 A 2/1988 Stampe
5,988,086 A 11/1999 Mitchell et al.

FOREIGN PATENT DOCUMENTS

FR 2628387 A1 9/1989

* cited by examiner

*Primary Examiner* — Edwin Swinehart
(74) *Attorney, Agent, or Firm* — Akerman Senterfitt

(57) ABSTRACT

A sail propulsion system for boats and the like comprises at least one mast (A) and a jib (F) controlled by sheets and secured to the head of the mast (A), as well as at least two mainsails (RS, RD) rove on two shrouds (S; SR) located one to the right and one to the left of the mast (A) and arranged each on a boom (B) mounted on one of said shrouds (S; SR). This sail system has a greater sail surface with respect to the conventional set of sails consisting of a single mainsail and the relevant jib, whereby with the same wind the sail thrust is greater, moreover the jib (F) and the leeward mainsail meet the wind like a single sail whose efficiency is greater than the efficiency of the two separate sails present in conventional equipments, and finally when sailing before the wind the sail surface has its center of thrust located on the boat axis so as to make the sailing more stable and less prone to rightward or leftward deviations of the bow, thus increasing safety and allowing to dispense with the use of special sails when sailing before the wind, such as the gennaker or the spinnaker.

7 Claims, 3 Drawing Sheets

SAIL PROPULSION SYSTEM

The present invention relates to sail propulsion systems for boats and the like, and in particular to a system comprising a jib and two mainsails rove on shrouds arranged to the sides of the mast. Specific reference will be made hereafter to the application of the present system to a single-masted boat, but it is clear that what is being said also applies to multi-masted boats and to land transportation means using a sail propulsion system.

It is known that a conventional sail propulsion system includes a jib and a single mainsail arranged all astern of the mainmast and secured between the mainmast, a boom and a gaff, if the sail is quadrangular, or only between the mainmast and the boom if the sail is triangular as in modern mainsails. On the contrary, the jib is a triangular sail arranged before the mainmast with its leading edge rove on the cable supporting the mainmast towards the bow (stay) and it is controlled only by the sheets. Such a set of sails allows a good sailing close to the wind but is not very effective when sailing before the wind, unless through the use of particular type of sails like spinnaker and gennaker.

Therefore the object of the present invention is to provide a sail propulsion system which overcomes the above-mentioned drawbacks.

This object is achieved by means of a sail system comprising in addition to the conventional jib also two mainsails rove on two shrouds located one to the right and one to the left of a same mainmast. Other advantageous features are disclosed in the dependent claims.

The main advantage of this sail system stems from the greater sail surface supported by the mainmast with respect to the conventional set of sails consisting of a single mainsail and the relevant jib, whereby with the same wind the sail thrust and therefore the speed of the boat provided with the present propulsion system are greater than those of a boat with conventional equipment.

A second significant advantage of the present sail system is given by the fact that the jib and the leeward mainsail meet the wind like a single sail having an area almost equal to the sum of the areas of the two sails, due to a little overlap, and therefore form a sort of airfoil whose efficiency is greater than the efficiency of the two separate sails present in conventional equipments.

Still another considerable advantage of said sail system is the fact that when sailing before the wind the sail surface has its center of thrust located on the boat axis rather than eccentric as in conventional boats, and this makes the sailing more stable and less prone to rightward or leftward deviations of the bow, especially in the presence of waves. This is a great advantage in terms of safety and allows to dispense with the use of special sails when sailing before the wind, such as the gennaker or the spinnaker.

These and other advantages and characteristics of the sail propulsion system according to the present invention will be clear to those skilled in the art from the following detailed description of some embodiments thereof, with reference to the annexed drawings wherein.

Figure 1:
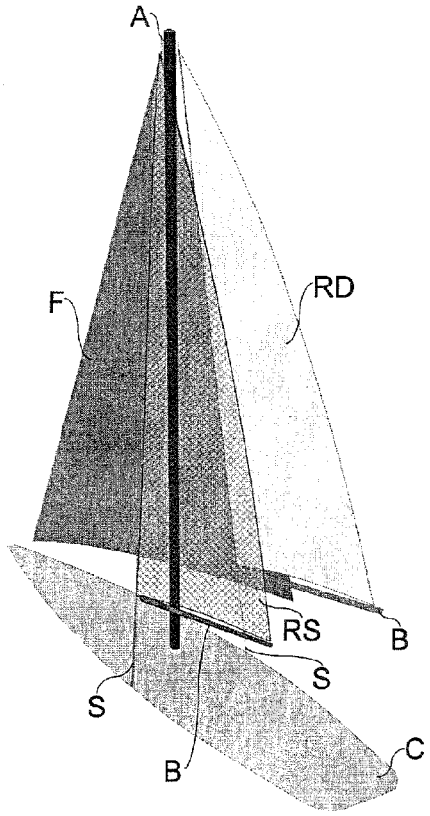
FIG. 1 is a diagrammatic rear perspective view of a first embodiment of a boat provided with the sail system according to the invention, the sails being arranged for sailing close to the wind.

Referring to FIG. 1, there is seen that the novel sail propulsion system according to the present invention comprises: a) a conventional jib F, whose top vertex is secured to the head portion of a mainmast A; b) a left mainsail RS rove on a shroud S, secured on deck C to the left of the mainmast A, and arranged on a boom B also mounted on said shroud S; c) a similar right mainsail RD arranged between a relevant boom B and a relevant shroud S secured on deck C to the right of the mainmast A.

In this first embodiment the two mainsails RS, RD are rove on the same lateral shrouds S that support the mainmast A, but also other types of rigging are possible as it will be illustrated further on.

Figure 2:
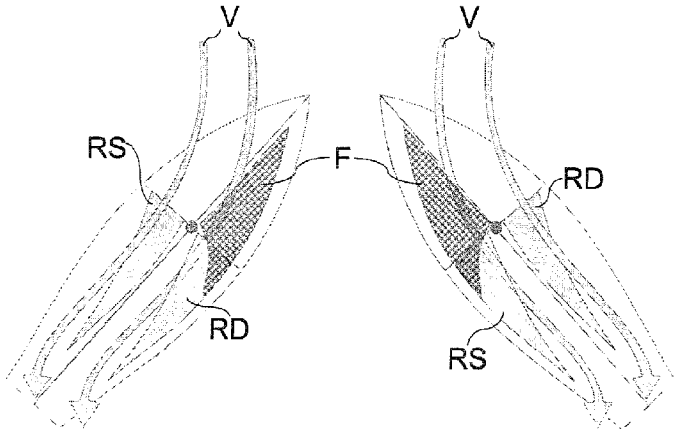
FIG. 2 is a top plan view of the boat of FIG. 1 showing the arrangement of the sails for sailing close to the wind port tack and starboard tack.

As shown in FIG. 2, when the boat sails close to the wind the jib F and the leeward mainsail (RD port tack, RS starboard tack) meet the wind V like a single sail, thanks to their little overlap, while the windward mainsail works alone providing an additional thrust to the system.

When sailing close to the wind, the two mainsails RS, RD work with almost parallel profiles and when the sailing side is changed with respect to wind V the jib F is tacked to the new side so as to form a single profile with the new leeward mainsail, whereas the mainsails do not require any manoeuvre other than a trimming adjustment to the new direction.

Figure 3:
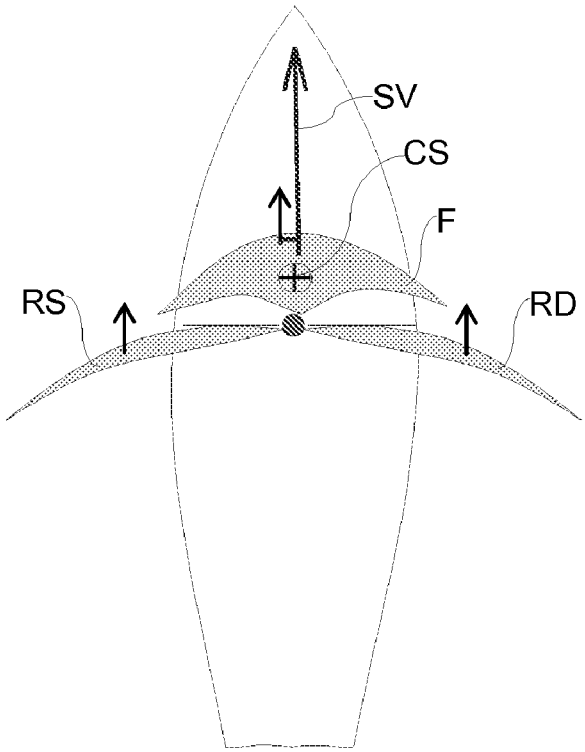
FIG. 3 is a top plan view showing the arrangement of the sails for sailing before the wind.
Figure 4:
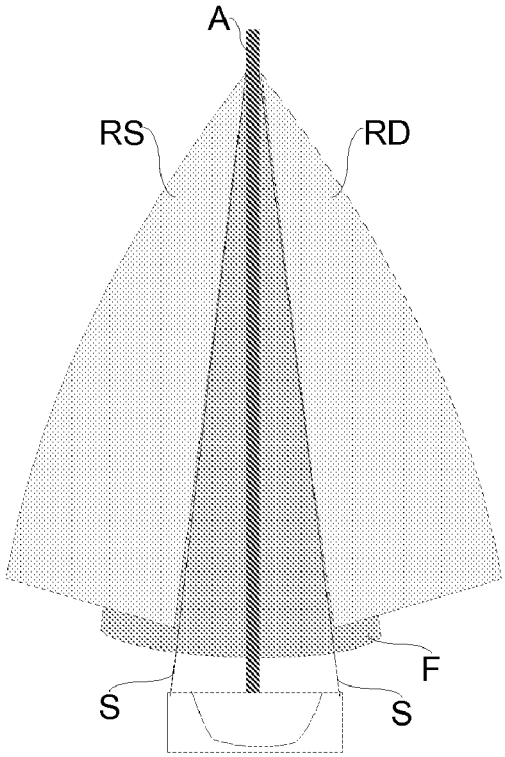
FIG. 4 is a diagrammatic rear view of the boat of FIG. 3.

Referring now to FIGS. 3 and 4, there is seen that when sailing before the wind the two mainsails RS, RD can be arranged symmetrically with respect to the mainmast A, while the open space remaining between the two mainsails can be covered by a suitable triangular sail or by the jib F itself. In this way, the thrust contributions of each sail (indicated by the short arrows) are combined into an overall sail thrust SV whose center of thrust CS results substantially on the boat axis, resulting in the above-mentioned advantages of safe and stable sailing.

Figure 5:
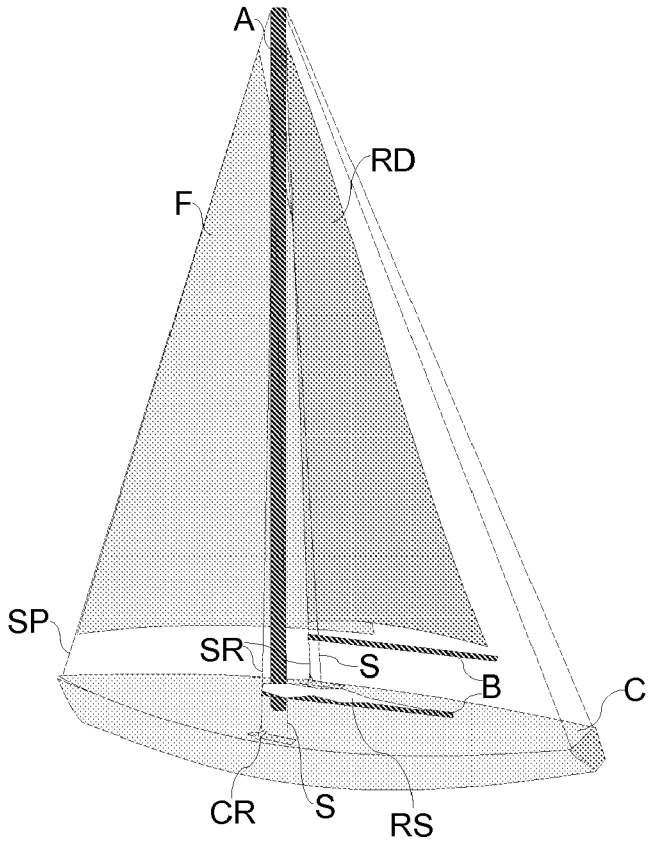
FIG. 5 is a diagrammatic rear perspective view of a second embodiment of the rigging to be used with this sail system.
Figure 6:
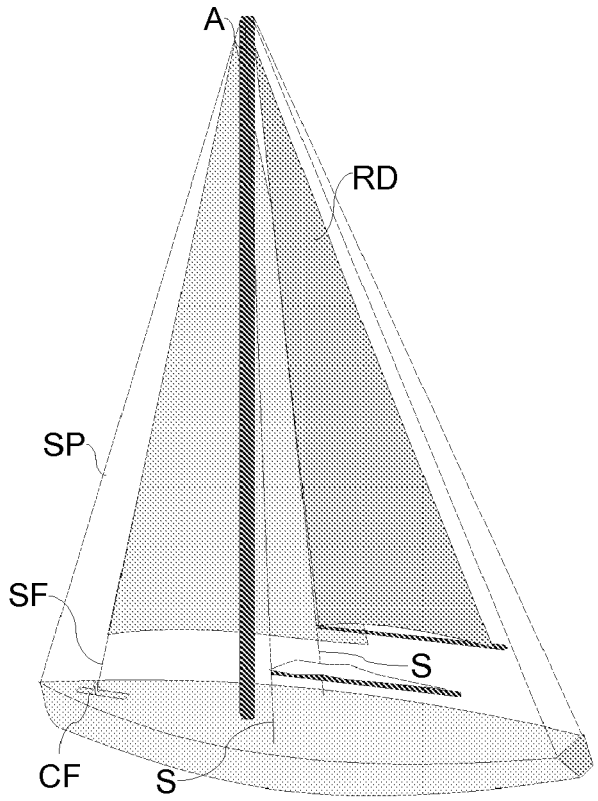
FIG. 6 is a diagrammatic rear perspective view of a third embodiment of the rigging to be used with this sail system.

Finally, in the diagrammatic views of FIGS. 5 and 6 other two possible solutions for the rigging to be used with this sail system are illustrated.

The first solution provides a mainmast A conventionally rigged with a forestay SP on which the jib F is rove, while the two mainsails RS, RD (the left mainsail RS being illustrated furled on the relevant boom B) are rove on proper dedicated shrouds SR extending between the head of the mainmast A and the deck C to the sides of the mainmast A. In this case, the point of connection to the deck C of each mainsail shroud SR can be secured on a mobile carriage CR so that the mainsail shroud SR can be moved fore and aft on the deck to search for the optimal sail balance.

In the second solution the rigging is simpler because the mainsails RS, RD are rove on the lateral shrouds S of the mainmast A, while the jib F is rove on a proper jibstay SF that from the head of the mainmast A extends down to the deck before the mainmast A yet aft of the forestay SP. In this case, the foot of the jibstay SF can be secured on a mobile carriage CF so that the search for the optimal sail balance can be performed by moving the jib F fore and aft.

Obviously, in order to have the maximum flexibility in sail adjustment nothing prevents the combination of the two solutions above into a fourth embodiment comprising both carriages CR and carriage CF.

It is clear that the above-described and illustrated embodiments of the sail system according to the invention are just examples susceptible of various modifications. In particular, shape, size and materials of the members that make up said sail system can be freely changed according to specific design requirements as long as the overall structure of the system is retained.

The invention claimed is:

1. A sail propulsion system for boats, comprising:

at least one mast (A) located in the longitudinal midplane of the boat;

two lateral shrouds extending obliquely between the head portion of said mast (A) and points of connection to a deck (C) of the boat, located respectively to the right and to the left of the mast (A);

a jib (F) controlled by sheets and secured to the head of the mast (A);

two booms (B), each one of said two booms (B) being mounted on one of said two shrouds located one to the right and one to the left of the mast (A); and two mainsails (RS, RD), each one of said two mainsails (RS, RD) being rove on one of said two shrouds located one to the right and one to the left of the mast (A) and being arranged on one of said two booms (B).

2. The sail propulsion system according to claim 1, wherein, when the boat sails close to the wind, the jib (F) and the leeward mainsail (RS, RD) are slightly overlapped.

3. The sail propulsion system according to claim 1, wherein the points of connection of the two lateral shrouds to the deck are secured such that the two lateral shrouds on which the two mainsails (RS, RD) are rove also support the mast (A).

4. The sail propulsion system according to claim 1, further comprising additional lateral shrouds that support the mast, wherein the two lateral shrouds on which the two mainsails (RS, RD) are rove are dedicated shrouds (SR) for supporting the mainsails, said dedicated shrouds (SR) being separate from the additional lateral shrouds (S) that support the mast (A).

5. The sail propulsion system according to claim 4, wherein the point of connection to the deck (C) of each mainsail shroud (SR) is secured on a mobile carriage (CR) that is movable in the longitudinal direction of the boat.

6. The sail propulsion system according to claim 1, wherein the jib (F) is rove on a dedicated jibstay (SF) that from the head of the mast (A) extends down to the deck (C) before the mast (A) yet aft of a forestay (SP).

7. The sail propulsion system according to claim 6, wherein a foot of the jibstay (SF) is secured on a carriage (CF) mobile in the longitudinal direction.

* * * * *